US006158870A

United States Patent [19]

Ramirez

[11] Patent Number: 6,158,870

[45] Date of Patent: Dec. 12, 2000

[54] COMBINATION MUSICAL AND LIGHTABLE BABY BOTTLE

[76] Inventor: John A. Ramirez, 28680 Woodland Rd., Paola, Kans. 66071

[21] Appl. No.: 09/080,896

[22] Filed: May 18, 1998

[51] Int. Cl.[7] ..... F21V 33/00

[52] U.S. Cl. ..... 362/101; 362/234; 362/86; 215/11.1

[58] Field of Search ..... 362/86, 101, 253, 362/234, 251, 802; 215/11.1; 446/304, 404

[56] References Cited

U.S. PATENT DOCUMENTS

| | | | |
|---|---|---|---|
| 4,678,093 | 7/1987 | Allen | 215/11 R |
| 4,886,183 | 12/1989 | Fleming | 220/739 |
| 5,044,509 | 9/1991 | Petrosky et al. | 215/366 |
| 5,119,279 | 6/1992 | Makowsky | 362/101 |
| 5,344,034 | 9/1994 | Eagan | 215/11.1 |
| 5,644,745 | 7/1997 | Uesugi | 395/392 |
| 5,662,406 | 9/1997 | Mattice et al. | 362/101 |
| 5,664,745 | 9/1997 | Hadaway | 248/105 |

*Primary Examiner*—Stephen Husar
*Attorney, Agent, or Firm*—Shook, Hardy & Bacon L.L.P.

[57] ABSTRACT

A nursing baby bottle attachment with (an) entertainment device(s) associated therewith, especially the options of both, or either, chosen jingles of music and randomly flashing lights. Such may be just the music, or the paired music and lights with a micro-switch to turn off the lights alone.

17 Claims, 3 Drawing Sheets

24
22
27
6.
28
26
26a
29
34a
30
34
3.
20
21
31
36
33
40
45
23
4.

COMBINATION MUSICAL AND LIGHTABLE BABY BOTTLE

BACKGROUND OF THE INVENTION

Usually, a bottle feeding baby will cooperate from hunger and habit to inhale the quantities of milk in his/her bottle without argument or delay. On the other hand, inherent insubordination and self exerting innate resistance may cause stalling for the feeding time, which may or may not be of significance to the mother or feeder. The evident solution, if it is a solution, to the stalling of feeding is to also amuse the child while it has possession of the bottle.

This may typically be done one of two ways. First is a distribution of lights around the periphery of the bottle, which twinkle on and off in untimed or random pattern. Perhaps this is the less attractive of the two modes, depending on the ear of the infant. Secondly, short jingles incorporating new or old tunes can be made audible by the infant pressing on a particular pressure point on the shaft of the bottle, either below or above or in a single line on the outside of the bottle.

Of course, all electrical devices which must be employed both in the flickering lighting and the provision of alternative tunes must be electrically screened entirely from the child.

OBJECTS OF THE INVENTION

It may be seen that one object of the present invention is to provide a baby bottle with a source or sources of music attached thereto.

It is another object of the present invention to provide a musical baby bottle that is relatively simple to manufacture and to attach to, and detach from, existing baby bottles.

It is a further object of the present invention to provide a musical baby bottle where different tunes can be actuated by the movement of the tips of the fingers of the baby or infant feeding itself.

Yet another object of the present invention is to provide a musical baby bottle which is inherently safe for the baby being fed. The music not only diverts occasionally a temperamental child's attention from the feeding process, but also may help to induce the infant into sleep after feeding.

An object of the present invention is to provide a unique electronic musical producer and adapter for use with a baby nursing bottle, which adapter is readily detachable from the bottle, with its related equipment in which, when the bottle is placed in a position with the tips of the infant's finger touching pressure points, produces various musical tunes or other noises or sound, as provided, to soothe and amuse the infant.

As another object of this invention, the holder of the milk or feeding bottle is not dishwasher safe, per se, that is, by itself. The bottle should be removed for cleaning from the holder.

As another object, when it is preferable to feed an infant at night or in a darkened room without turning on the main room light may be typically bright, the flashing randomized light sources turned on by the micro-switch are enhanced.

Another object of the present invention is to provide an illumination and/or playing device for a baby bottle or other drinking container which is easy to manufacture, simple to assemble, reliable in operation and relatively inexpensive, as well as safe and long storable without deterioration.

Another object of the invention is to provide a baby bottle with a source or sources of flashing lights attached thereto.

Another object of the present invention is to provide a flashing light baby bottle attachment relatively simple to manufacture and to attach to and detach from existing baby bottles.

A further object of the present invention is to provide a flashing light baby bottle, where random, flashing lights are actuated by a manual switch operated by the father or mother or other person caring for and feeding the child.

Another object of the present invention is to provide a flashing light baby bottle inherently safe for the baby being fed.

Another object of the invention is to provide a flashing light baby bottle, which operates to divert a temperamental child's attention from the feeding process.

Another object of the present edition is to provide a unique electrical-electronic random flashing light producer and adapter for a use with a baby nursing bottle, which adapter is readily detachable from the bottle after use with its related equipment in which, when the bottle is placed in a position between the tips of the infant's fingers and the switches, when activated by the parent and child, produces a random pattern of flashing lights on the outside of the bottle and/or musical jingles from a speaker, respectively.

Another object of the invention is to provide a baby bottle with both a source of music and random, flashing lights attached thereto usable one alone or both together.

Another object of the present invention is to provide a musical baby bottle that is also a flashing light baby bottle that is simultaneously or separately relatively simple to manufacture and to attach to and detach from existing baby bottles for the feeding process and after the feeding process.

Another object of the present invention is to provide a musical baby bottle for different tunes are actuated by movements of the fingers of the child feeding itself, and where a random, flashing light pattern may also be provided by the actuation of a simple mechanical on-off switch.

Yet another object of the present invention is to provide an alternative or simultaneous musical and randomly flashing light baby bottle, which is inherently safe for the baby being fed. The music and/or lights divert the temperamental child's attention from the feeding process to the facilitate the latter.

Another object of the present invention is to provide a unique electronic musical producer and adapter for use with a baby nursing bottle, which also is provided alternatively or simultaneously with a random flashing light pattern built into the "skin" of the bottle encasement so that when the lights are activated by a manual switch of the feeder, such will occur. Secondly, when the bottle is placed in a position with the tips of the infant's finger touching pressing points, various musical tunes or other noises or sounds are produced to soothe and amuse the infant.

In the foregoing will be found the means for optimizing the feeding characteristics of a bottle fed baby, including separate lights, separate music jingles or combinations of both.

Other and further objects of the invention will appear in the course of the following description.

THE PRIOR ART

Applicant is aware that music and lights have been used as various purpose devices for liquid containers, including baby bottles, and lists as the most pertinent prior art found in a search:

U.S. Pat. No. 4,678,093, Allen, Jul. 7, 1987, "Musical Baby Bottle;"

U.S. Pat. No. 4,886,183, Fleming, Dec. 12, 1989, "Beverage Container Holder;"

U.S. Pat. No. 5,344,034, Eagan, Sep. 6, 1994, "Musical Adapter For Baby Nursing Bottles;"

U.S. Pat. No. 5,644,745, Hadaway, Sep. 9, 1997, "Musical Baby Bottle Adapter;"

U.S. Pat. No. 5,119,279, Makowsky, Jun. 2, 1992, "Lighted Drinking Vessel;" and

U.S. Pat. No. 5,662,406, Mattice, Sep. 2, 1997, "Lighted Baby Bottle."

DESCRIPTION OF THE DRAWINGS (FIGS. 1 through 6 show the musical version of the device.)

Figures 1, 2, 3, 4, 5:
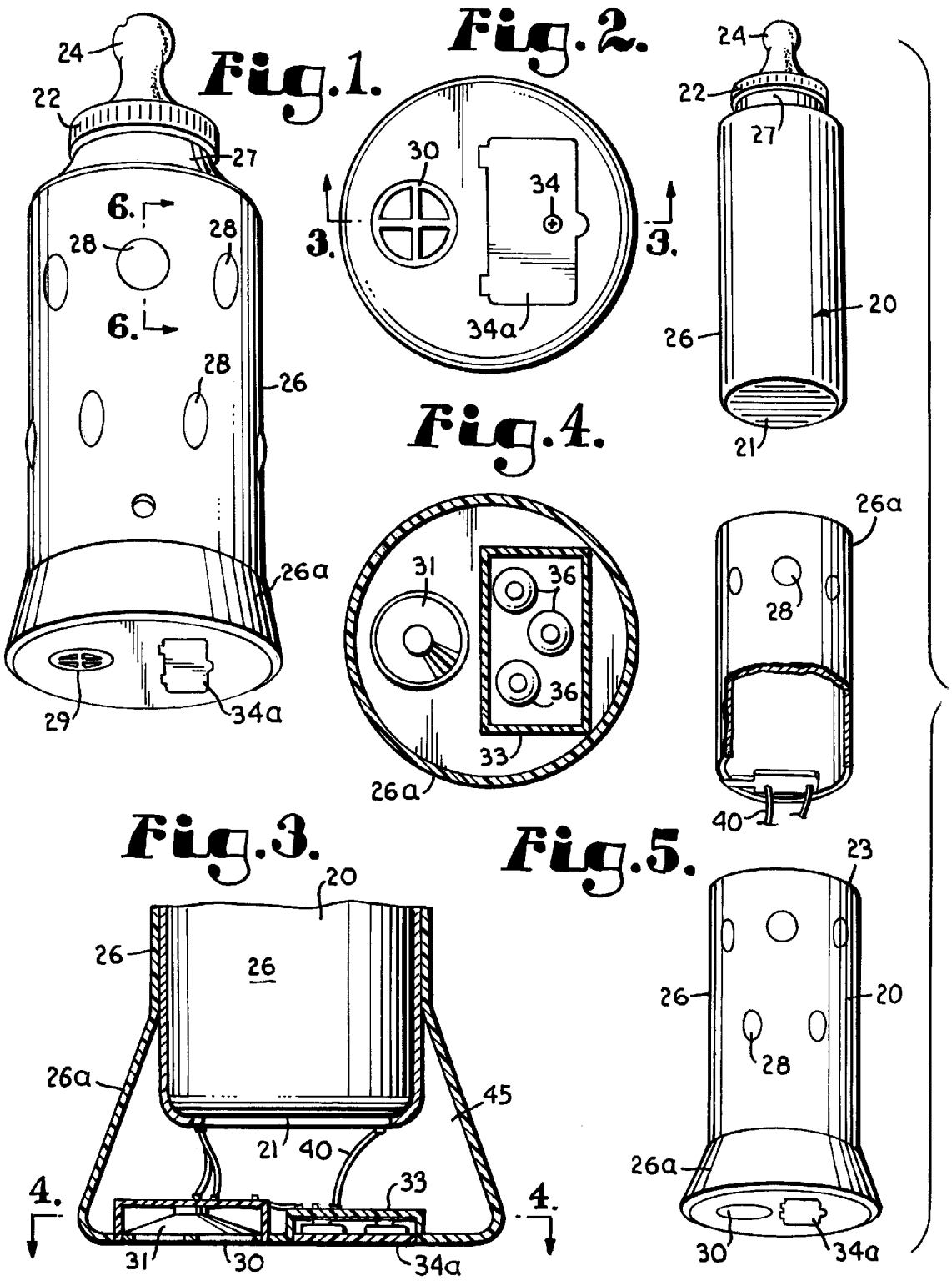
FIG. 1 is a ¾ perspective from below of a cylindrical sleeve receiving a cylindrical baby feeding bottle for playing music showing the push buttons with speaker and battery box at the lower enlarged portion of the bottle.
FIG. 2 is a bottom view of the device of FIG. 1.
FIG. 3 is a view taken along the lines 3—3 of FIG. 2 in the direction of the arrows.
FIG. 4 is a view differing from FIG. 2 in that the player or speaker guard is removed, as well as the screw-in top or bottom of the power box of cylindrical pill-like batteries.

FIG. 5 is an exploded view of the device of FIGS. 1–4, inclusive, showing the elements of the device exploded, one from the other. (1) The top figure is the normal milk bottle for a baby feeding bottle. (2) The middle figure is the electrical web which is insulated on the inside and fits the height of the bottle down to near the enlargement. The inner sleeve, if there be an inner insulating sleeve between the center and top Figures goes under the bottle and is continuous. (3) The bottom Figure of FIG. 5 is the sleeve which runs substantially the height of the milk bottle and has the push points registering with the electrical conveyor system (center Figure of FIG. 5).

Figure 6:
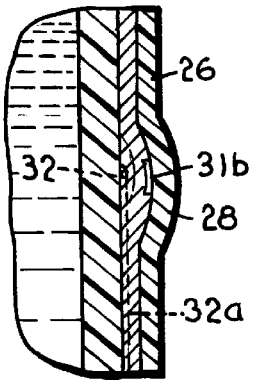

FIG. 6 is a view taken along the line 6—6 of FIG. 1 in the direction of the arrows and shows one method of sleeve on sleeve pressure with the outer sleeve at the inward push-point, preferably metallized for the proper contact.

FIGURES FOR LIGHTING SYSTEMS

Figure 7:
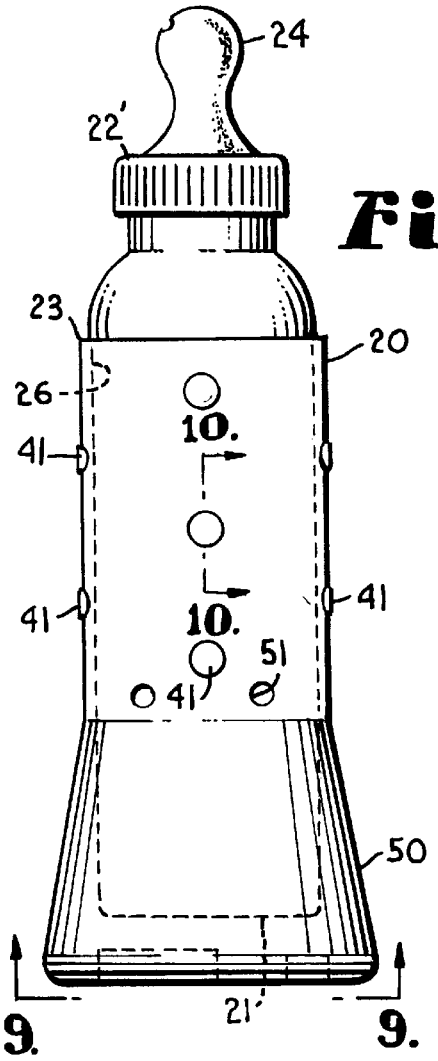

FIG. 7 is a device like that of FIG. 1, but incorporating an array of steady or flickering lights therewith with a randomizer chip in the electrical system to not play the lights in regular array unless so wished.

Figure 8:
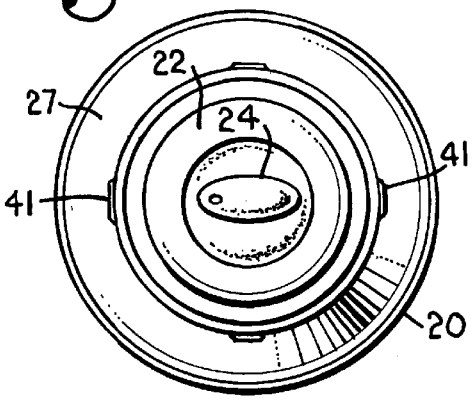

FIG. 8 is a top view of the device of FIG. 7 showing the nipple, the inward converging of the bottle at the top, the inner and outermost skins of electrical system to cause the individual lights to flash on in random order, and the outward spread of the lower bottom of the sleeve carrying the bottle.

Figure 9:
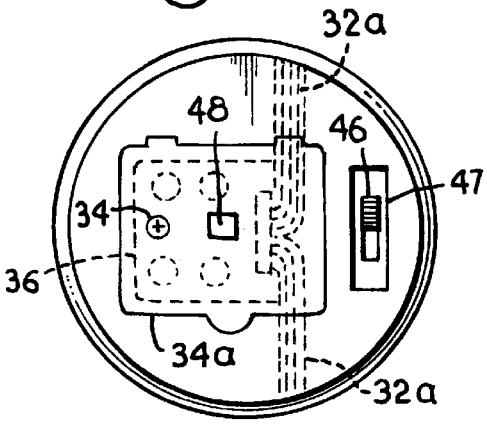

FIG. 9 is an underside view of the power pack and wires to the individual lights.

Figure 10:
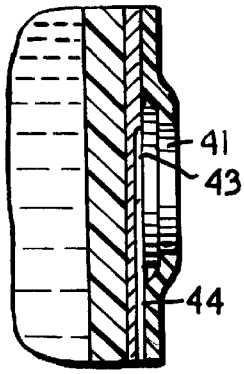

FIG. 10 is a view taken along the line 10-10 of FIG. 7 in the direction of the arrows.

THE COMBINED VERSION

Figure 11:
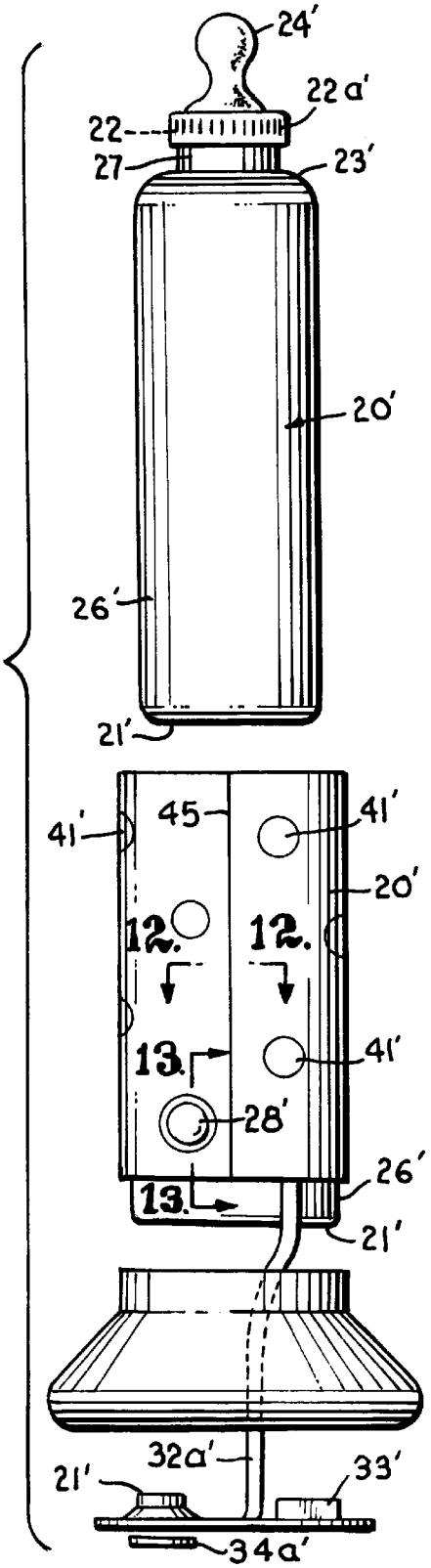

FIG. 11 is a view like that of FIG. 5 showing the parts of the joint device exploded from one another vertically. FIG. 11 shows the two layers of bottle covering to hold the bottle in the base 50'.

Figure 12:
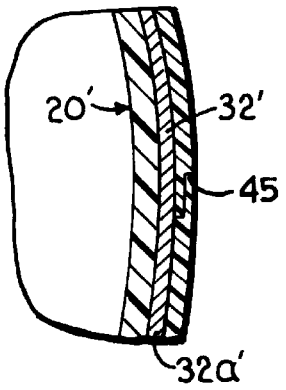

FIG. 12 is a view taken along the line 12—12 of FIG. 11 in the direction of the arrows.

Figure 13:
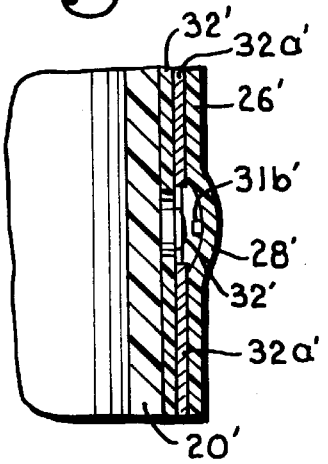

FIG. 13 is a view taken along the line 13—13 of FIG. 11 in the direction of the arrows and shows a musical push-button.

Figure 14:
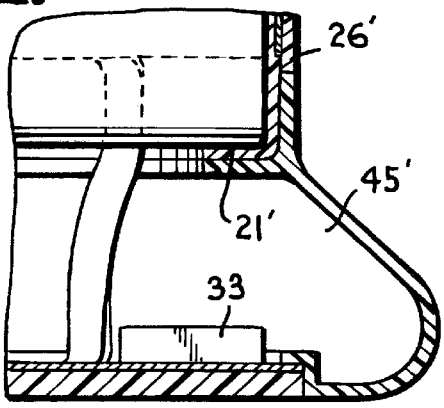

FIG. 14 shows the assembled bottom of the device with the power cable able to feed either the musical side of the device or the lighting side of the device.

DESCRIPTION OF THE INVENTION (FIGS. 7–10)

Lighting Array Bottle Cover

The insulated illuminated baby bottle cover in FIGS. 7–10 consists of an electrical storage housing 34*a* with a flickering light microchip 48 and a battery pack 36, which is located at the bottom of the bottle cover 50. Also, the bottom electrical storage housing (battery pack and microchip) 34*a* is made in a recess 34*b* of lightweight, dense Styrofoam or other filler material 50 at the bottom. (To remind parents long removed from the bottle feeding time of children, typically, such comprises a glass or plastic cylindrical bottle (usually rigid) 20' with a rounded, flat bottom 21' and a nipple bearing cylindrical (removable), lesser diameter supple receiving zone 27' at the top.)

The cylindrical bottle 26 holder 26 at top is made of lightweight glass/plastic/hard rubber, being thin, waterproof insulation, there being small, colored or clear, flat lights 32, FIG. 6; 41, FIG. 7; FIG. 10; and 41', FIG. 11; and vinyl sheeting there over through which the lights shine.

The light weight rubber or plastic bottle holder 21 rises to a rim 23' and is the only thing that will make contact with the bottle. That is, the hardest contact with the bottle, as compared with the friction fit skin and bottom of the electrical sleeve interior of the skin of the vinyl carrying the lights therethrough. It has a continuous closing lower bottom on which the bottle rests.

On the outside of the lightweight plastic will be a thin sheet (second sheet) of insulation that will be glued to the plastic sheet extending the whole side of the bottle, and will also cover the electrical storage housing (down to the bottom of the outside stand of the bottle itself). On the outside of the insulation between the lights and the plastic sheet will be small, flush lights, 32, 41 and 41' tightly fixed to the inward insulation sleeve of plastic. This plastic sleeve will cover from the top to the bottom of the bottle cover, including over the electrical storage housing with a door for battery and replacement thereof and switch and microchip to be described. It is fixed with non-toxic glue.

The top portion of the two plastic sheets, where they meet, will be tightly mended together (glued to each other so the insulation will not be exposed). Toward the bottom, there will be four air vented holes 51 in the two sheets for easy entry and exit of the baby bottle into the sleeves of vinyl or other plastic material carrying the bulbs and the openings therefor. At the bottom of the electrical storage housing will be a thin, hard plastic base that will have a screw lock 34 for the battery access door.

There are many colors and patterns of different colors of lights and geometry thereof that could be cut in the vinyl side hole sheets and various placing of the lights so the lights can line up and form up different designs, such as faces, animals, star combinations, etc., just to name a few. This product may brighten a child's eye of any proper age to use as a baby bottle, restore appetite and after the installation, will help keep him/her, via the fluid in the bottle, either cold or warm.

In the base of this bottle, as in the case of the base of the bottle for music to be described, it is preferable that the diameter of the base be greater for frusto-conicallity (the bottle is typically cylindrical) and the circuit be bonded to the inner floor layer of Styrofoam 45 or other plastic, or foam filter. An outer, lower floor is provided for, additionally, the battery pack itself (with replaceable batteries) and a speaker. The speaker faces down to the surface of any holding material when the bottle is rested. There must be an on-off switch 46, which will trigger the power being lead to a randomized chip 50*a* which flashes given lights. There will be, typically, two wires to each light and they gang up on the bottom of the bottle holder or bottom holder and connect the powerful set of batteries like hearing aids/timer for bulbs between the switch and the lights. The Light Emitting Diode (LED) bulbs are flat as possible. There is a screw lock 34 battery access door 34*a* to avoid falling out of the batteries. Typically, up to fifteen flashing lights may be employed at randomized positions on the exterior of the bottle. The on-off switch 47 with the timer for the lights and the recess for the power pack are all preferably mounted in the very bottom, flat bottom of the device.

THE MUSICAL BABY BOTTLE COVER

Second Part of the Invention

FIGS. 1–6, Inclusive

The insulated musical baby bottle cover consists of an electrical storage housing that is located at the bottom of the bottle cover analogous to the last described, holding the battery pack, speaker and the sound chip. The storage housing 26*a,* of preferably greater cylindrical diameter, is made of solid or light weight dense Styrofoam or like material. The configuration of both bottle receivers is analogous in numerous ways. First, there is a frusto-conical, center hole bottom piece which is adapted to receive the bottom of the sleeved bottle therewithin, and the battery pack, chips, switch or speaker. This storage housing is made of light weight dense material, electrically insulating, and firmly grasping the bottom of the sleeved bottle.

The bottle holder, in each case, is made of light weight "rubber," vinyl or other thin, waterproof insulation. In this case, pressure sensitive sound sensor buttons in vinyl, the buttons randomly or in one or more rows riding or rising up the exterior of the bottle.

This bottle holder is made of said light weight insulation material, continuous, from top, around the bottom, constituting thin, waterproof insulation, including pressure sensitive sound sensor buttons and the material that ties all together. The light weight "rubber" or vinyl insulator located in the middle of the bottle cover (at the top) is the tightest contact with the bottle. The remainder is sleeved on the bottle and covers it entirely save for the speaker 31, 30, etc. On the outside of the light weight insulation sleeve with buttons, will be the thin insulation of "rubber" or plastic glued to the inner plastic sleeve and also covering the electrical components housing. This means that the outer sleeve is continuous and overlies the pressure switches (FIGS. 1, 6 and 13) on the inside insulation.

Thus, on the outside of the outer insulation sheet, will be metallic or electrical conducting material spots approximately ½ inch in diameter in various places around the bottle cover over the metallic spots that the pressure arising from the sound sensitive sound sensors will be placed.

Electrical wires or electronic strips go from the sound card, between the sleeving of the one or more levels of the bottle encasement, to the pressure sensors that activate the speaker circuit line in the second level and down to the selector of music prints in the base of the bottle.

The outer surface vinyl will, optionally, have brightly printed colors all around it and special shapes and colors over the pressure points, depending on the sound the sound card makes (all short tunes, but not too short, differ from one another). New, as well as old fragments of tunes and modified fragments thereof are triggered by the pressure to the buttons.

The outer insulation will cover the entire sleeve of the bottle to the bottom of the bottle cover, including the electrical storage housing, where it will be firmly glued with non-toxic glue along the way. The top, where the inner insulation or rubber top lip and seals with the vinyl outer sleeve is tightly glued or attached to the upper portion of the bottle (typically just inside the break in the curve of the bottle at the top to take the nipple). Toward the bottom level, there will be open outer shield vent holes for easy entry and exit of the baby bottle and cover, yet, there is a friction fit once in place. Four typical holes, 90 degrees apart are adequate, usually. More or less may be used as required as well as diameter.

At the bottom of the electrical component storage is a hard plastic sheet 30 with small speaker holes cut through for sound to emit and a screw locked battery cover 34*a* across the battery recess plate 33. This plastic base is also glued and tightly attached to the vinyl side wall. It is understood that the outermost vinyl/insulator sheet fairs outwardly to overlie the entire base, where it increases in diameter from the length of the bottle.

Many different sounds can be employed for the records in the responder to the baby button pressure points, including the tunes spoken of, animal noises, words and different kinds of musical horns, motor planes and helicopter noises, to name just a few. One feels that this would be fun and very educational for any age bottle feeding child and even years older, one hesitates to admit, plus the insulation will actually keep the fluid either cold or warm. What is here, as is the case of the lights, is a feeding bottle sheath combined with a toy for the child. These lights and tunes, as well may be imagined, can be used on adults past the bottle (milk) feeding epoch.

FURTHER NATURE OF THE INVENTION (MUSICAL)

The insulation sleeve in both embodiments of the invention is made of one piece of cylindrical rubber or plastic material approximately 3/16 inch thick. The insulation will cover the height of the uniform diameter portion of the bottle, including the bottom. It will have a snug fit, so the bottle will not easily slide out. The insulation is the only material that will be touching the bottle, except for air access at the vent holes.

The printed circuit sheet in the musical version will wrap around and over the insulation and will stay on with adhesive or glue. Over this sheet will be a thin sheet of plastic, with holes over the vent points. This sheet is to provide a little space between the pressure points and the metallic spots that will be located on the back of the vinyl cover.

The top of the microchip board should be glued to the bottom outside the insulation sleeve. The printed circuit sheet is provided outside the inner insulation sleeve in the musical version.

The base may be made of Styrofoam or like material with a thin, strong plastic bottom. The Styrofoam is formed to fit the speaker(s) under the bottle (the battery pack and openings for the wires to connect from the microchips to the speaker and the battery pack), or the base could be made of hollow molded plastic. The thick, strong plastic bottom could be molded to accept the speaker and battery pack, then glued onto the base. The speaker and battery pack is then installed in the plastic bottom. The speaker cover is then glued on to the speaker opening and the battery access door can be screwed in place. If we are to use a molded, hollow plastic base, it would not have to be as tall and would still be as lightweight. The speaker cover 30, of course, is perforated for emission of sound.

The vinyl outer sleeve will fit around both the insulated sleeve and base. On the inside of the outer vinyl sleeve will be metallic spots. These spots will be located directly over the pressure points on the printed circuit sheet. The metallic spots activate the music as they touch the pressure points on the circuit sheet. Such vinyl sleeve may have bright colors printed on it and special pictures, shapes, colors and or words in the areas where the pressure points are.

MORE MUSICAL VERSION BACKGROUND

The typical parts of the insulated-musical baby bottle cover are insulation sleeve (inner); printed circuit sheet; thin sheet of plastic (outer) without holes or relief; microchips and board; microchip board cover; speaker; batteries and battery pack; wires; base (formed Styrofoam or molded hollow plastic); hard plastic bottom of base (molded) speaker cover; screw-locked battery access door; vinyl or other like insulator outer sleeve; and glue. After all the pieces are installed properly, the top of the insulation and the top of the vinyl must be molded together for a tight fit. This does not make the entire assembly water washable, however. The vinyl sleeve (outer) must fit firmly, all the way to the base, approximately 3 and ½ inches down from the top.

Three or more ventilation holes must be made or provided in order to permit easy insertion and removal of the bottle in the sleeves. The outer insulation sleeve and the inner insulation sleeve must be fixed together tightly. If they are sealed below the inward curve of the upper nipple, then there is no problem of removal of the bottle from the sleeve.

Evidently, squeezes of the bottle (musical) at the same point will produce a reproduction of the sound recorded for that point again. The infant may obtain favorites. When the on-off circuit in the flashing light zone has been switched on, the lights do not light simultaneously, but flash randomly from the selector. Flush lights are desirable so that the infant will not "nibble" the bottle outside and crush any of the lights.]

COMPARISON OF DEVICES

The devices are essentially the reverse of one another. In the light device, the power source is connected to a plurality of individual wires or tapes which go to each different light from the microchip. On the other hand, in the musical device, the device is played only if the child pushes the switch of one of the tunes and plays it with the electrical impulse going down to the particular portion of the multi-package of music to play a particular tune.

It is not desirable to have the speaker exposed to water in washing.

THE COMBINED INVENTION (2)

There is no reason why the combination of the scintillating spaced lighting and points of pressure for music cannot be added to a single bottle. The only difference is that (1) the bottom volume may have to be increased and/or (2) two extra layers of electrical insulating material are added to either form. A single set of push buttons for the music and a single set of lights may be employed or the entire array may be arranged around the upper surface or rising surface of the sheathed milk bottle. The two electrical systems must be isolated and insulated from one another. Of course, this is an alternative system, as the on-off switch seen in FIG. 9 may be left off to avoid running the batteries down if the child goes to sleep with the bottle wedged in the bed.

A separate bottom closure and sleeve for each extra system is best, and the middle system, if the systems are stacked for power, etc., at the bottom, may be perforated for electrical junction with water/milk/formula sealing.

The edges should be rounded to avoid injury to the child. In both cases, the outwardly angled frusto-conical bottle carrier may be increasingly staggered or double-staggered of the same width or even, in either case, merely double-heighted. This would make essentially a completely round bottle, but is not preferred because of the stability of the outwardly angled base of the device. However, a single set of power units may be employed if the batteries are strong enough and of long enough duration to run either or both systems. At present, the double power unit is best.

The three sheets or two sheets may be sealed together, and preferably so, at the top of the bottle, just before the break inwardly toward the nipple-fitting area. In any case, the bottle sleeve may be single or multiple for the described effects.

STRUCTURE AND FUNCTION (LIGHTING)

The objects of this invention are four-fold. They are all developed for one purpose, namely, to amuse a bottle feeding infant. They involve two separate alternatives, one double alternative and one optional of two alternatives. At (2) in FIG. 5 one sees the cylindrical side wall and at 21, the bottom of a normal plastic or glass baby bottle which is to be tightly sheathed in a cover which is electrically nonconductive. The neck portion of the bottle is seen at 22, the top portion of the sleeve ending below 23. A normal baby bottle nipple 24 is shown mounted on the top of the bottle above the necking-in portion of the bottle, which has a ridge **22*a* to embrace for sealing. The sealing sleeve on the bottle completely encloses the lower part of it, including bottom 25, and is continuous. This is plastic/rubber or some like or equivalent material. Vinyl may do. The side vertical walls of the bottle are seen at 26 and the neck-in portion of the bottle at the top at 27**. The bottle itself is typically shatter resistant glass or plastic and of sufficient strength that an infant's hands will not crush it. The two drawings sheets illustrate two different amusement modes for the infant and so will be separately described. They may be combined simply, without interaction, to obtain a double effect of action as will be described.

Turning back to the first sheet, having FIG. 5 thereon, there may be seen the entire sleeve **26*a* of the device removed from the bottle while the baby's milk/food is being formulated, or just for storage. This (drawing sheet 1) shows the musical form of the invention and depressable switches 28 are provided at intervals, such as two parallel vertically spaced rows as seen in the bottom part of FIG. 5. They may, however, be placed on the sleeve 26*a*** in a more random pattern.

The sleeve **26*a* itself, which the bottle is slipped downwardly into, comprises electrically sensitive sheets of switching material which is readily obtainable in any fairly sophisticated electrical/electronic supply shop. Each pressure point 28 (FIG. 6) is connected to one of these switching devices, which leads to the power pack seen closed in FIG. 2, open in FIG. 4 and in section in FIG. 3. What is needed is a speaker, shown to the left in FIGS. 3, 2 and 4, as well as FIG. 1 at 29**. These lines lead down to a random choosing device, also commonly available in stores which make it a fact that when the baby pushes inwardly on one of the pressure points, a given tune or fragment of a tune or "jingle" is played at and according to that pushing point.

FIG. 2, at 30, shows a guard for the screen of the speaker, FIG. 4 the speaker 31 itself with the guard removed at 29 and FIG. 3, the speaker 21, its guard 30 (downwardly) and the frame 31*a* which overlies and protects the speaker and permits the electrical connection thereto. A randomizer chip may be employed or such may be omitted so that each push point has a given tune associated with it.

FIG. 6 shows a typical pressure point 28 with a metallic piece 31*b* or electrically conductive piece fixed to the inside of a slightly dimpled portion 28 adapted to contact electrical member 32 running down wire 32*a* to the power display or section topped at 33, with a screw 34 (FIG. 4), removable device, a plurality of batteries of as great power and duration as possible for the size, 36 therewithin (these batteries enclosed by wall 37), thence the electrical connection to the speaker at 31, best seen in the center bottom of FIG. 4. The result of this construction is that as the baby feeds, its fingers wander over the surface of the bottle, which it manipulates, and touches and depresses members such as 6 to play a tune. The various wires may be collected as seen in FIG. 9 on each side of the lower part of the device to go to the power section in a simple order, whereby there is no necessary randomizer, but a wire to power connection for each wire.

THE COMBINED SYSTEM (LIGHTS AND MUSIC)

This same arrangement may be employed with the second of the amusement devices involved here, where flashing lights are employed as at 41, 43 connected through wires 44 and shining through transparent dimples 45 outside the wall 26 of the bottle. In the lighting system, generally speaking, all the lights are randomly lighted at one time by means of a single mechanical switch 47 via thumb button 46 (FIG. 9). The point here is that the individual may activate the lights and tunes as he sees fit, with this arrangement. On the other hand, there may be a simple wire from each push button in FIGS. 1 through 6 to the selector whereby one tune is played for a time and then when it runs out, stops.

Thus, it is seen, alternatively, that a sleeve employing electrical connections 28 to the power 36 in FIGS. 1–6 with activation by movement of the infant's fingers. The lights may all be illuminated and different colored or same colored in the other form of the apparatus. The lights 41 are illuminated by the switch 47.

It may be seen that there are, at least, several options of use of this configuration, or these combined configurations. (1) If a single music pressure point is pressed, a single tune will be played (the music pressure points are usually placed further apart than the reach of the baby's fingers). The pressure of a separate baby's finger or multiples thereof on a tune player will result in one tune.

(2) Alternatively, if the switch 46 is turned on, all the lights will be randomly turned on, whether or not the music is played.

Each of these configurations can be used separately or together. It should be noted that the sleeve on the milk bottle, if used with lights and music, a double power source, or single power source (of sufficient power capacity) may be employed. If lighting only is used, the entire inside of the sleeve may be electrically connected to give total lighting, and if both sleeves are employed, the music sleeve may advantageously be outboard, while both sleeves must be electrically insulated from each other and the power and communication, as well as control means of each. These are standard matters which will not be described in detail.

FIG. 12 shows, at 45, the connecting of the outer sleeve parts to each other in the single lighting situation.

THE STRUCTURE AND FUNCTION (LIGHT ARRANGEMENT—FIGS. 7–10)

FIGS. 7–10 show essentially the lighting arrangement alone, with the sleeve 23 mounted, so only the lighting takes place therein. The wires are then gathered into a single, larger wire 46, which may be separately or integrally joined with the frusto-conical means which carries the lighting electrical power down to the base of the sleeve (FIG. 9). The frusto-conical member 50 receives, in a spaced fit, the baby bottle bottom with the sleeve or sleeves mounted thereon. Preferably, the outer part of the sleeve in the lighting situation is bifurcated, as at 45 in FIG. 12, to make a smooth closure while the musical device, if used therewith, may use such bifurcation or not.

FIG. 14 shows the details of the electrical connection from the universal electronic sleeve through electrical channel 51 to power at 52. The particular manner of connecting the baby bottle halves is not critical as long as there is sufficient space to fit.

FIG. 7 shows one mode of making this connection while FIG. 14 shows another.

From the foregoing, it will be seen that this invention is well adapted to teach all of the ends and objects hereinabove set forth together with other advantages which are obvious and which are inherent to the apparatus.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

What is claimed is:

1. A musical baby bottle module, the module comprising:

a first sleeve of material sized and shaped to receive and frictionally retain a baby bottle;

a second sleeve overlying the first sleeve and including one or more metalized contacts operable to generate electrical signals;

a frusto-conical base connected to the first sleeve; and a music generating device mounted within the base and electrically connected to the one or more metalized contact, said music generating device being activated upon receiving an electrical signal from the metalized contacts.

2. The module as recited in claim 1, wherein the music generating device includes a speaker, a power supply and a music generating chip operatively coupled together.

3. The module as recited in claim 1, wherein the metalized contacts are pressure sensitive contacts which produce an electrical signal upon receiving a sufficient pressure force from an external source.

4. The module as recited in claim 3, further comprising one or more brightly colored indicators located on an outer portion of the first sleeve and identifying the location of the pressure sensitive contacts.

5. The module as recited in claim 1, wherein the first sleeve is of a vinyl material.

6. The module as recited in claim 1, further comprising a plurality of ventilation holes in the first sleeve to facilitate insertion of the bottle within the first sleeve.

7. A self-illuminating baby bottle module, the module comprising:

a sleeve sized and shaped to receive and frictionally retain a baby bottle;

a frusto-conical base connected to the sleeve; and one or more light sources mounted on the sleeve and operable to emit light and provide amusement to a baby.

8. The module as recited in claim 7, further comprising a second sleeve for electrically insulating the baby bottle from the light sources.

9. The module as recited in claim 7, wherein the light sources are light emitting diodes.

10. The module as recited in claim 7, further comprising a power source and an activation switch located in the base, wherein the power source and the activation switch are electrically coupled with the one or more light sources.

11. The module as recited in claim 7, further comprising a randomized chip connected to and operable to control the one or more light sources.

12. The module as recited in claim 11, wherein the randomized chip activates the light sources in a randomized fashion.

13. The module as recited in claim 7, further comprising a plurality of ventilation holes in the sleeve to facilitate insertion of the baby bottle within the sleeve.

14. A baby bottle entertainment module, the module comprising:

a generally cylindrical first sleeve sized and shaped to receive and frictionally retain a baby bottle;

a frusto-conical base connected to the first sleeve;

one or more light sources mounted on at least the first sleeve of the module;

a second generally cylindrical sleeve overlying the first sleeve and including one or more metalized contacts operable to generate electric signals;

a music generating device mounted within the base and electrically connected to the one or more metalized contacts; and one or more pressure points mounted on the first sleeve and operable to activate the music generating source.

15. The module as recited in claim 14, wherein the music generating device includes a music generating chip, a power source and a speaker operatively coupled together.

16. The module as recited in claim 14, wherein the metalized contacts are pressure sensitive contacts which produce an electrical signal upon receiving a sufficient pressure from an external source.

17. The module as recited in claim 14, further comprising an activation switch and a randomized chip mounted in the base, the randomized chip being operable to activate the one or more light sources in a randomized pattern.

* * * * *